US010107607B1

(12) United States Patent
Burke et al.

(10) Patent No.: US 10,107,607 B1
(45) Date of Patent: Oct. 23, 2018

(54) RADIO FREQUENCY IGNITER

(71) Applicant: The United States of America as Represented by the Secretary of the Army, Washington, DC (US)

(72) Inventors: Gregory C. Burke, Piermont, NH (US); John Hirlinger, Hackettstown, NJ (US); Thomas DeVoe, Randolph, NJ (US); Christopher Csernica, Port Murray, NJ (US); Viral Panchal, Parlin, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/478,557

(22) Filed: Apr. 4, 2017

(51) Int. Cl.

| | |
|---|---|
| ***F42C 13/04*** | (2006.01) |
| ***F42C 11/00*** | (2006.01) |
| ***F42B 3/10*** | (2006.01) |
| ***F42B 5/08*** | (2006.01) |
| ***F41A 19/63*** | (2006.01) |
| ***F42D 1/045*** | (2006.01) |

(52) U.S. Cl.
CPC ..... *F42C 13/047* (2013.01); *F41A 19/63* (2013.01); *F42B 3/10* (2013.01); *F42B 5/08* (2013.01); *F42C 11/001* (2013.01); *F42C 13/04* (2013.01); *F42C 13/045* (2013.01); *F42D 1/045* (2013.01)

(58) Field of Classification Search
CPC ..... F42C 11/00; F42C 11/001; F42C 11/04; F42C 13/04; F42C 13/045; F42C 13/047; F42B 3/10; F42B 5/08; F41A 19/58; F41A 19/61; F41A 19/63; F42D 1/045
USPC ..... 102/200, 202, 202.5, 205, 214; 89/28.05
See application file for complete search history.

(56) References Cited

U.S. PATENT DOCUMENTS

| | | | | |
|---|---|---|---|---|
| 3,176,617 | A | 4/1965 | Brafford | |
| 3,601,054 | A * | 8/1971 | Christianson | F41A 19/63 102/200 |
| 3,811,359 | A * | 5/1974 | Marchese | F02K 9/95 102/380 |
| 4,363,273 | A | 12/1982 | Luebben | |
| 4,572,076 | A | 2/1986 | Politzer | |
| 5,146,044 | A * | 9/1992 | Kurokawa | F41A 19/63 102/200 |
| 5,454,323 | A | 10/1995 | Conil | |
| 5,672,842 | A | 9/1997 | Brion | |
| 5,747,723 | A | 5/1998 | Buckalew | |
| 6,152,039 | A * | 11/2000 | Lee | F02K 9/95 102/200 |
| 6,591,753 | B1 * | 7/2003 | Schmid | F42B 5/08 102/205 |
| 7,546,804 | B1 | 6/2009 | Tartarilla | |

* cited by examiner

*Primary Examiner* — James S Bergin
(74) *Attorney, Agent, or Firm* — John P. DiScala

(57) ABSTRACT

An ignition system for energetics including artillery charges includes a radio frequency transmitter and a radio frequency igniter. The radio frequency ignitor receives and converts radio frequency energy into heat or electrical energy for the purpose of igniting energetics, such as propellants or pyrotechnics. The radio frequency igniter may be applied to the exterior of the energetic container or may be integral to the container.

10 Claims, 8 Drawing Sheets

RADIO FREQUENCY IGNITER

FEDERAL RESEARCH STATEMENT

The invention described herein may be manufactured, used, and licensed by or for the U.S. Government for U.S. Government purposes.

BACKGROUND OF INVENTION

Field of the Invention

The present invention relates to energetic ignitors, and more particularly to radio frequency energetic igniters.

Related Art

Most conventional artillery systems are initiated by use of a center fire based primer housed within a metal casing. Such primers are typically initiated through electrical or mechanical (percussion) means. These systems in particular are used in medium and large caliber gun systems. Advanced artillery systems have explored the use of laser ignition systems wherein the propelling charge is ignited by an external laser emitter located in the breech of the artillery system.

A feature common in many conventional artillery charges is that the ignition impetus occurs at the rear of the charge. Under ideal conditions single point rear ignition spreads progressively forward through the propellant bed. However, predictable progressive ignition does not always occur and the results of which, such as weapon failure, can be catastrophic. In addition, single point rear ignition also requires complex and careful charge design consideration to avoid the generation of rarefaction waves.

As can be appreciated, the location of an ignition system in the breech of an artillery system presents numerous challenges. Among the most difficult of these challenges are those related to making the ignition system sufficiently robust to endure the continuous extreme vibration, shock and thermal excursions produced by the weapon system when fired, as well as the extreme environmental conditions such as long term storage and operation in hot/cold and wet/dry weather conditions.

SUMMARY OF INVENTION

The present invention relates to a radio frequency ignition system for igniting an energetic via electromagnetic energy.

According to a first aspect of the invention, a radio frequency ignition system includes a radio frequency emitter and one or more radio frequency ignitors. The radio frequency emitter emits electromagnetic energy into a resonant cavity. The one or more radio frequency ignitors are each attached to an energetic charge located within the resonant cavity. Each of the one or more radio frequency ignitors further comprises a first layer, a second layer and an initiating charge disposed between the first layer and the second layer. The first layer further comprises a radio frequency absorption material for receiving the burst of electromagnetic energy and converting it to a stimulus for igniting the initiating charge. The second layer further comprises an adhesive for attaching the radio frequency ignitor to the energetic charge.

According to a second aspect of the invention, a radio frequency ignition system includes a radio frequency emitter and one or more radio frequency ignitors. The radio frequency emitter emits electromagnetic energy into a resonant cavity. The one or more radio frequency ignitors are each attached to an energetic charge located within the resonant cavity. Each of the one or more radio frequency ignitors further comprises a radio frequency absorption material for receiving the burst of electromagnetic energy and converting it to a stimulus for directly igniting the energetic charge.

According to a third aspect of the invention, an ignition system for a weapon comprises a radio frequency emitter, a transmitting antenna and a plurality of radio frequency ignitor patches. The radio frequency emitter produces a burst of electromagnetic energy. The transmitting antenna protrudes into the breech of the weapon and broadcasts the electromagnetic energy into the breech. The plurality of radio frequency ignitor patches are each attached to a propelling charge for the weapon. The radio frequency ignitors simultaneously ignite upon reception of the electromagnetic energy. The plurality of radio frequency ignitor patches further comprise a first dielectric layer, a second dielectric layer and a initiating charge disposed between the first dielectric layer and the second dielectric layer. The first dielectric layer comprises a metallic film sized and dimensioned to convert the electromagnetic energy to thermal energy of a sufficient quantity to ignite the initiating charge. The initiating charge is positioned to ignite a center core charge of the energetic charge.

BRIEF DESCRIPTION OF THE DRAWINGS

The accompanying figures further illustrate the present invention.

The components in the drawings are not necessarily drawn to scale, emphasis instead being placed upon clearly illustrating the principles of the present invention. In the drawings, like reference numerals designate corresponding parts throughout the several views.

DETAILED DESCRIPTION

The present invention relates generally to the ignition of energetics using radio frequency energy. A radio frequency ignitor, such as a patch or localized zone, is designed to convert received electromagnetic energy to heat or electrical energy for the purpose of ignition of an energetic sources, such as pyrotechnic or propellant. One or more radio frequency (RF) devices may be attached upon, printed or embedded in the body of the energetic device. For purposes of clarity, throughout this specification, the RF igniter will be described in the context of igniting artillery charges, such as the Modular Artillery Charge System (MACS) currently fielded by the United States Army; however, the RF igniter is not limited to igniting artillery charges, specifically, or to military applications, in general.

Figure 1:
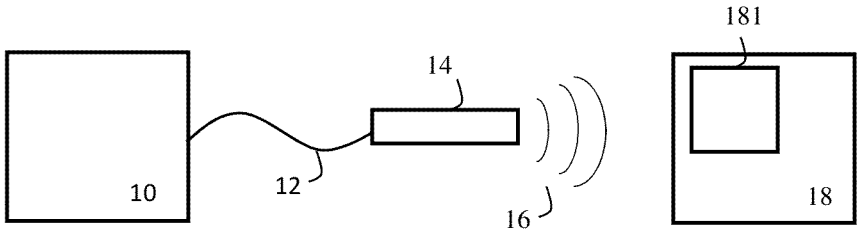
FIG. 1 illustrates an ignition system comprising a radio frequency igniter, in accordance with an illustrative embodiment of the invention.

FIG. 1 illustrates an ignition system comprising a radio frequency igniter, in accordance with an illustrative embodiment of the invention. The ignition system comprises an RF emitter 10, a RF transmission cable 12, an antenna 14 and an RF ignitor 18. The RF emitter 10 produces a burst of electromagnetic energy 16 for a short duration coupled into and through an RF transmission cable 12 or alternatively can be directly couple to a radiative antenna 14 located within the confines of a combustion chamber. For example, the RF emitter 10 may be a high power emission source such as a magnetron.

The RF ignitor 18 receives the electromagnetic energy 16 and converts it to ignite an energetic charge, such as a propelling charge. The conversion process can be a thermal conversion or a more complex method such as driving of a micro-based laser initiation device or ignition source. In an embodiment of the invention, the RF ignitor 18 receives the electromagnetic energy via an RF absorption material, such as an antenna, and initiates the first element 181 of an ignition chain, through dielectric heating, which progresses into the main propellant charge 18. In another embodiment, the RF ignitor 18 receives the electromagnetic radiation to produce an electric voltage for powering an ignition device such as a micro-based laser initiation device. In this embodiment, ignition is initiated through a micro-electronic package which may be capable of providing bi-directional communication as well as ignition. For example, in one embodiment, the temperature, age, lot and other attributes of the propellant may be communicated over the bi-directional communication link.

Figure 2:
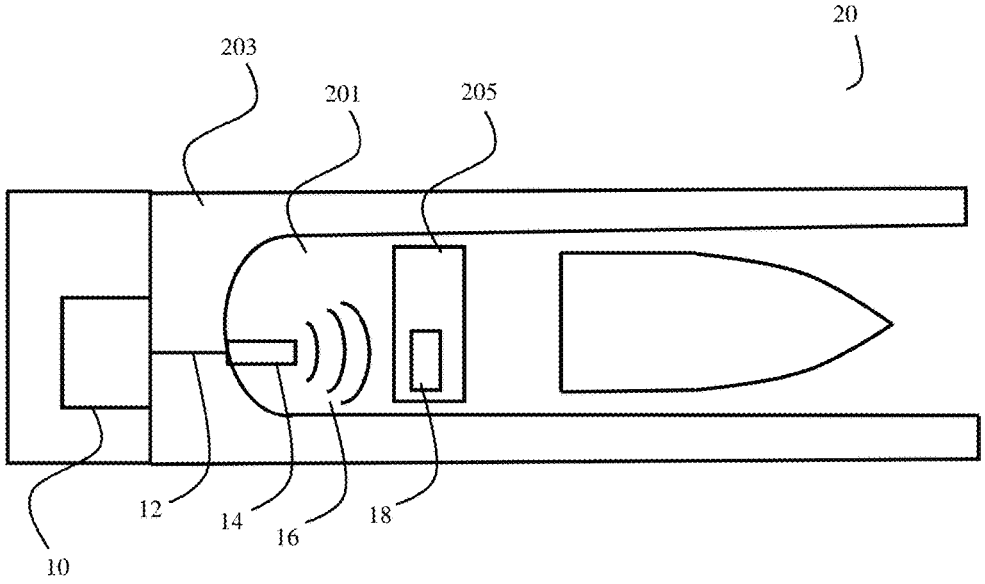
FIG. 2 is a cutaway view of an artillery system employing a radio frequency igniter, in accordance with an illustrative embodiment of the invention.

FIG. 2 is a cutaway view of an artillery system employing a radio frequency igniter, in accordance with an illustrative embodiment of the invention. In one illustrative embodiment, the RF ignitor 18 is employed in an artillery piece 20 to ignite one or more propelling charges 205.

The RF emitter 10 may be external to the artillery piece 20 or may be integral to the artillery piece. The RF emitter 10 produces a burst of electromagnetic energy 16 for a short duration coupled into and through an RF transmission cable 12 or alternatively can be directly coupled to a radiative antenna 14 located within the confines of the breech 201 (or combustion chamber) of the artillery device. For example, the RF emitter 10 may be a high power emission source such as a magnetron that may broadcast energy into the breech at a sufficient level to ensure ignition. In one embodiment, the RF emitter radiates approximately 1 kilowatt (kW) of energy for a duration of approximately 1 millisecond (ms).

The RF emitter 10 is coupled by a flexible transmission cable 12 to the breech 201 of the artillery system. In an embodiment, the RF transmission cable 12 is disposed in place of the mechanically based percussion primer which are typical of currently available artillery systems.

The transmission cable 12 passes through the breech block 203 and is coupled to an antenna 14 disposed in the breech 201. The transmission antenna 14 may be an exposed limited use antenna 14 or can be covered within a rugged, long life ceramic composite structure. However, the radiating antenna 14 structure is not limited to ceramics but may instead use a combination of various conductive and/or dielectric composites, meta-materials or metals to achieve the same result.

The transmission antenna 14 serves as a pressure seal for the breech 201 thereby allowing for the conduction of RF signals into the breech 201 as well as sealing the pressure vessel. The pressure vessel being made of thick steel and completely sealed ensures that no RF energy 16 escapes or places any personnel at risk from exposure.

The breech 201 of the artillery piece 20 serves as a cavity resonator, radiating the RF energy 16 within the breech 201. An RF ignitor 18 is coupled to a propelling charge residing in the breech 201. The RF ignitor 18 receives the electromagnetic energy 16 and converts it to an electric voltage which initiates the ignition chain of the propelling charge. For example, the RF ignitor may directly ignite the propelling charge with the converted electromagnetic energy 16 or may comprise an additional initiating charge 181 which is ignited by the converted electromagnetic energy 16 and which in turn initiates the ignition chain of the propelling charge.

Figure 3:
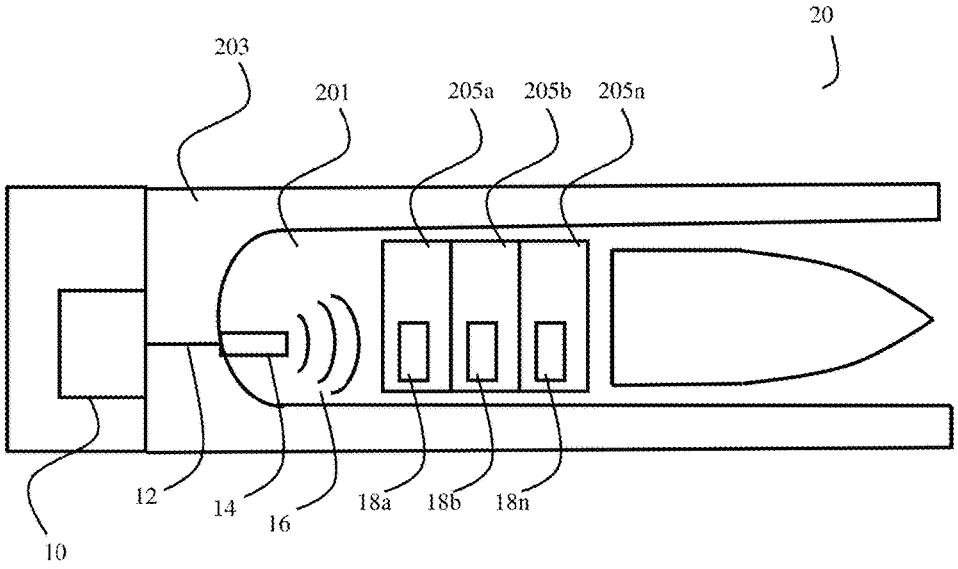
FIG. 3 is a cutaway view of an artillery system employing multiple radio frequency igniters, in accordance with an illustrative embodiment.
Figure 4:
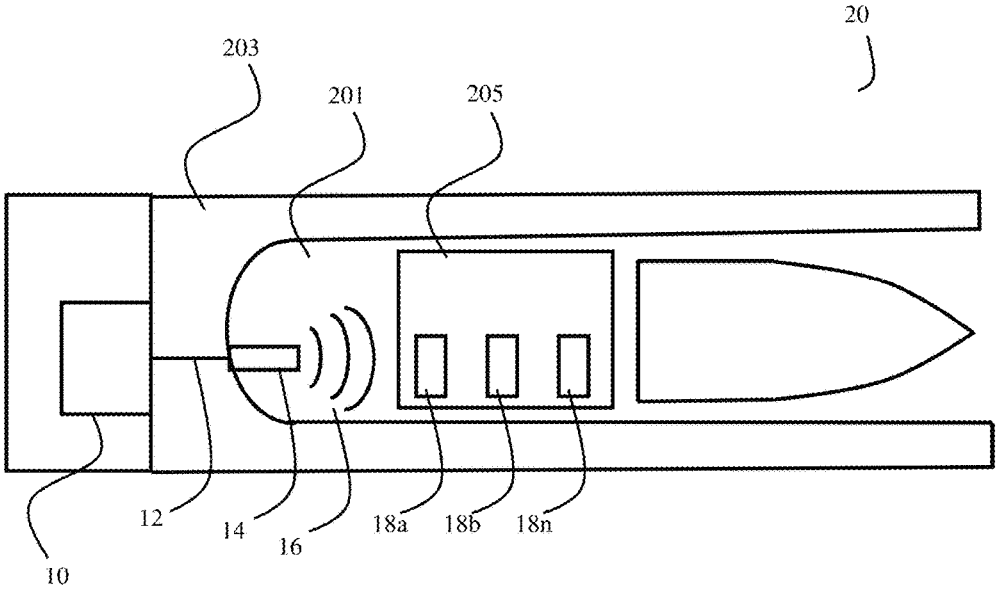
FIG. 4 is a cutaway view of an artillery system employing multiple radio frequency igniters, in accordance with an illustrative embodiment.

FIG. 3 and FIG. 4 are cutaway views of an artillery system employing multiple radio frequency igniters to achieve multi-point ignition, in accordance with an illustrative embodiment. In an embodiment of the invention, one or more radio frequency igniters 18 are employed to achieve multipoint ignition. Depending on the application and the type and geometry of the propelling charge, multiple RF ignitors 18 may be coupled to a single charge, multiple charges may each have a coupled RF ignitor 18 or there may be a combination of the two.

As shown in FIG. 3, in applications in which multiple propelling charges are employed in the artillery system, such as in a modular or staged system like the MACS, an RF ignitor 18 may be attached to each propelling charge. Each of the propelling charges 205*a, n* comprises an RF ignitor 18*a,n* attached to the propelling charge. While the RF ignitors 18*a,n* are shown attached to the sides of the charges, this is for illustrative purposes only. As will be described below, placement of the RF ignitor on the propelling charge is determined by the geometry of the propelling charge and location of the propelling charge primer.

Upon reception of the RF energy 16 by the RF ignitors 18*a,n*, each RF ignitor 18*a,n* simultaneously ignites their respective propelling charge 205*a,n*, thereby providing reliable multipoint ignition. Reliable multipoint ignition ensures ballistic predictability for the propelling round. By simultaneously igniting the multiple charges, the premature detonation of subsequent charges in the propulsion chain is negated as may be experienced in traditional rear ignition systems.

In applications employing one or more relatively longer charges in a single case, it may be advantageous to attach multiple RF ignitors 18*a,n* to a single charge to achieve multipoint ignition within the charge. For example, depending on the type and location of the propellant within the charge, multiple RF ignitors can ensure simultaneous ignition of all propellant within the charge thereby providing the benefits described above.

Figure 5:
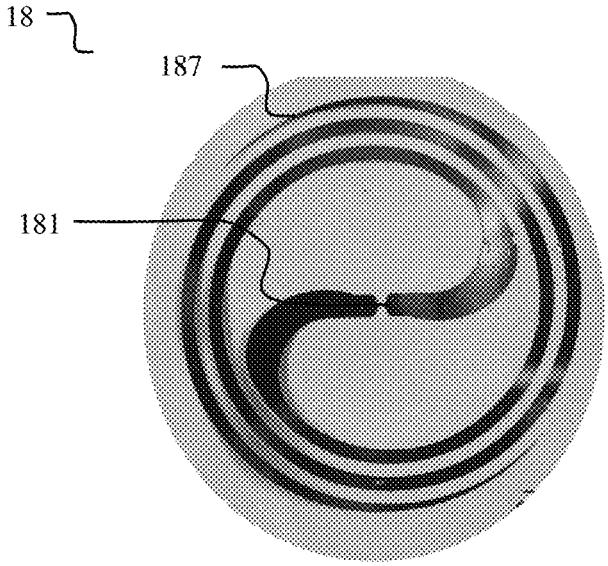
FIG. 5 is front view of a radio frequency igniter, in accordance with an illustrative embodiment of the invention.
Figure 6:
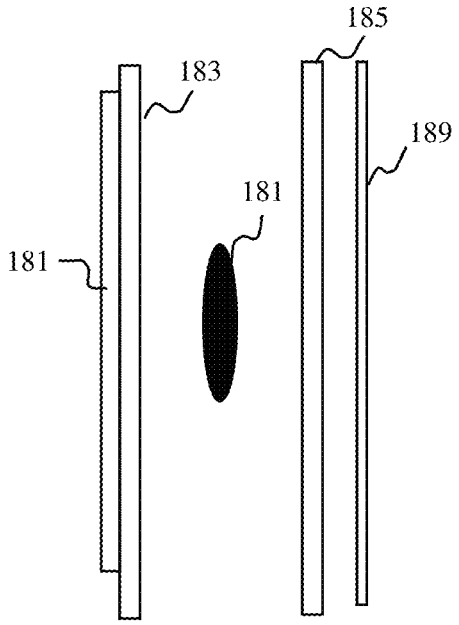
FIG. 6 is an exploded view of a radio frequency igniter, in accordance with an illustrative embodiment of the invention.

FIG. 5 is a front view of a radio frequency igniter, in accordance with an illustrative embodiment of the invention and FIG. 6 is an exploded side view of a radio frequency igniter, in accordance with an illustrative embodiment of the invention. In an embodiment, the RF igniter 18 is a patch which may be adhesively attached to the energetic charge. The patch comprises a first dielectric layer 183 having an RF absorption material 187, a second dielectric layer 185 and an initiating charge 181 disposed between the two dielectric layers. In one embodiment, the dielectric layers are formed of a polyester or polyimide material, such as Mylar or Kapton material; however, the dielectric layers are not limited to polyesters or polyimide materials like Mylar or Kapton.

Contained within the first dielectric layer 183 is RF absorption material 187 for converting the electromagnetic energy 16 into heat. A wide variety of materials may be employed, including metallic films, nano-metallic particles, a printed antenna made from conductive inks, metamaterials and fine steel wool. In the embodiment shown in FIG. 5, the RF absorption layer comprises a metallic receiving antenna printed on the first dielectric layer. The size and dimensions of the antenna may be varied to optimize the heat generation depending on, among other things, the wavelength and magnitude of the electromagnetic energy. For example, the dipole metallic antenna printed using conductive ink as shown in FIG. 5 is an example of one type antenna.

An initiating charge 181 is disposed between the first dielectric layer 183 and the second dielectric layer 185. In a preferred embodiment, the initiating charge 181 is not impact sensitive but will ignite when exposed to heat from the RF absorption material 187. For example, the initiating charge 181 may be as simple as a black powder mixed with a thermite or some of the more novel compounds such as MIC, (metastable intermolecular composites). In an alternative embodiment, the initiating charge 181 comprises nano-metallics which function as the RF absorption material 187 thereby negating the need for a distinct antenna component.

An adhesive layer 189 is applied to the outer surface of the second dielectric layer 185 for attachment to the propelling charge 205.

Figure 7:
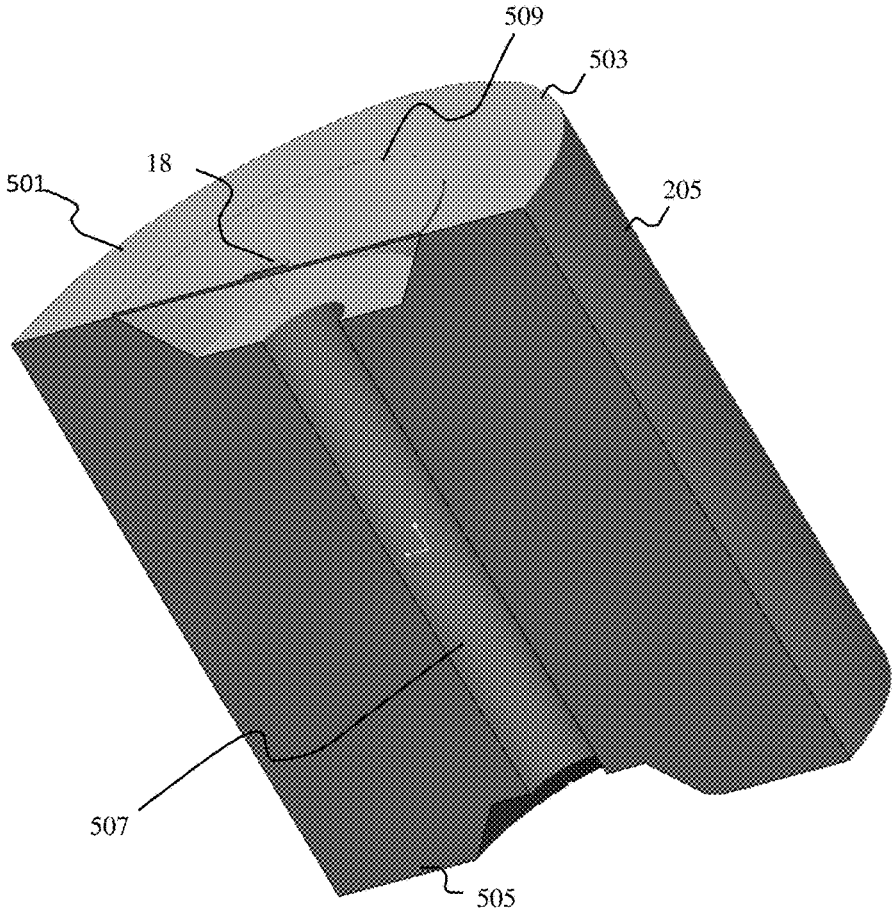
FIG. 7 illustrates a cross sectional view of a modular propelling charge with a radio frequency igniter, in accordance with an illustrative embodiment of the invention.

FIG. 7 illustrates a cross sectional view of a modular propelling charge with a radio frequency igniter, in accordance with an illustrative embodiment of the invention. Advantageously, via the adhesive layer 189 the RF ignitor 18 may be integrated with legacy charges such as the Modular Artillery Charge System (MACS) propelling charges currently fielded by the United States Army by adhering the radio frequency igniter to a top or bottom face of the charge. In the embodiment shown in FIG. 7, the patch is affixed on top of the existing red Mylar environmental seal 509. Placement above the center core 507 allows the radio frequency ignitor 18 to initiate the legacy energetic, typically a black powder bag, located in the center 507 in legacy systems and for ignition to progress into the bi-directional center core ignition system disclosed in U.S. Pat. No. 7,546,804 issued Jun. 16, 2009 to Tartarilla et al. and assigned to the United States as represented by the Secretary of the Army.

In alternative embodiments, the MACS propelling charges include a center core ignition system comprising a printed conductive ink RF antenna on the surface of the center core ignition system material. For example, a foamed celluloid center core ignition system may include a printed RF antenna for initiating ignition of the charge.

The ignition of the radio frequency ignitor 18 initiates an ignition chain which includes ignition of the preliminary charge (i.e. core igniter bag or center core ignition) in the center core of the propelling charge and ultimately progressing into the main propellant housed in the propelling charge.

Figure 8:
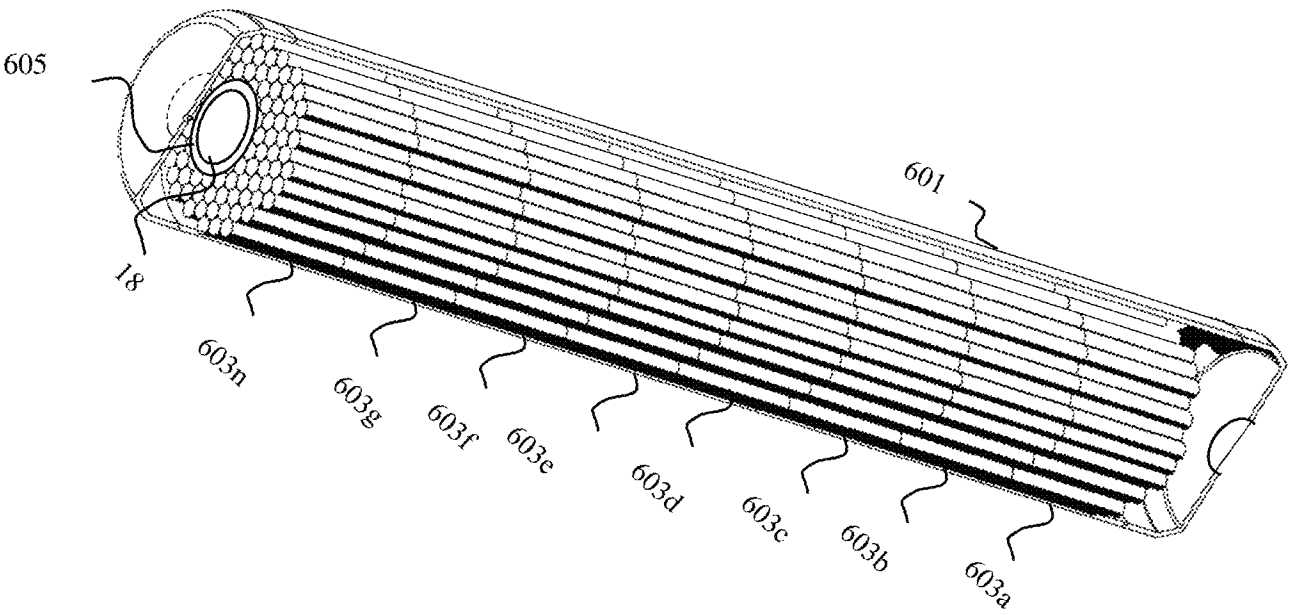
FIG. 8 illustrates a cross sectional view of a propelling charge with inserted radio frequency igniters, in accordance with an illustrative embodiment of the present invention.

FIG. 8 illustrates a cross sectional view of a propelling charge with inserted radio frequency igniters, in accordance with an illustrative embodiment of the present invention. In other embodiments of the invention, the RF ignitor may be inserted within the case. For example, the supercharge comprises a single case 601 housing multiple bundles of propellant sticks 603*a,n* stacked vertically on top of each other in the case. In such an embodiment, an RF ignitor 18 on a combustible substrate 605 may be inserted between groups to achieve multipoint ignition. The RF ignitor 18 may be a patch, such as the type shown in FIGS. 5 and 6, affixed to a consumable substrate 605, such as a foamed celluloid substrate. In another embodiment, the RF absorption material and/or energetic material may be printed directly on the consumable substrate 605.

In other embodiments of the invention, the RF absorption material is printed or embedded directly onto the charge case. In such an embodiment, the propelling charge is preferably encased in a container formed of a consumable material such as nitrocellulose or foamed celluloid. The antenna can be printed using a conductive ink, such as silver ink on Kapton™. In such an embodiment, the energetic may be printed or deposited directly onto the antenna and sealed in place using a third printing process. For example, in an embodiment for the next generation munition, the antenna may be printed or placed between each bundle of propellant. Alternatively, the RF absorption material may be embedded into the charge container. For example, in a propelling charge encased in foamed celluloid, the foamed celluloid may be formed around the RF absorption material and initiating charge.

We claim:

1. An ignition system comprising:

a radio frequency emitter emitting electromagnetic energy into a resonant cavity;

one or more radio frequency ignitors each attached to an energetic charge located within the resonant cavity, each of the one or more radio frequency ignitors further comprising a first layer, a second layer and an initiating charge disposed between the first layer and the second layer wherein the first layer further comprising a radio frequency absorption material for receiving a burst of the electromagnetic energy and converting it to a stimulus for igniting the initiating charge and the second layer further comprising an adhesive for attaching the radio frequency ignitor to the energetic charge.

2. The ignition system of claim 1 wherein the resonant cavity is the breech of a weapon barrel.

3. The ignition system of claim 2 wherein the RF emitter is coupled to an antenna protruding through the breech block of the weapon barrel.

4. The ignition system of claim 2 wherein the energetic charge is a propelling charge for an artillery shell.

5. The ignition system of claim 4 wherein the propelling charge is a modular artillery charge system propelling charge.

6. The ignition system of claim 5 wherein the RF ignitor is attached on a surface of the modular artillery charge system propelling charge above the center core.

7. The ignition system of claim 1 wherein the first layer and the second layer are dielectric materials.

8. The ignition system of claim 1 wherein the RF absorption material is an antenna.

9. The ignition system of claim 1 wherein the stimulus for igniting the initiating charge is thermal energy.

10. The ignition system of claim 1 wherein the one or more radio frequency ignitors are configured for simultaneously igniting upon reception of the electromagnetic energy.

* * * * *